US005693427A

United States Patent [19]

Moysan, III et al.

[11] Patent Number: 5,693,427

[45] Date of Patent: *Dec. 2, 1997

[54] ARTICLE WITH PROTECTIVE COATING THEREON

[75] Inventors: Stephen R. Moysan, III, Douglasville; Rolin W. Sugg, Reading, both of Pa.

[73] Assignee: Baldwin Hardware Corporation, Reading, Pa.

[ * ] Notice: The term of this patent shall not extend beyond the expiration date of Pat. No. 5,413,875.

[21] Appl. No.: 577,076

[22] Filed: Dec. 22, 1995

[51] Int. Cl.[6] ..... B32B 15/04; B32B 15/00; C25D 3/00

[52] U.S. Cl. ..... 428/627; 428/660; 428/675; 428/680; 428/661; 428/672; 428/668; 205/176; 205/192; 205/255; 205/247; 205/257

[58] Field of Search ..... 205/255, 261, 205/266, 271, 176, 192, 247, 257; 428/639, 627, 469, 615, 660, 675, 680, 661, 672, 668

[56] References Cited

U.S. PATENT DOCUMENTS

| | | | |
|---|---|---|---|
| 2,432,893 | 12/1947 | Holt et al. | 204/43 |
| 2,653,128 | 9/1953 | Brenner et al. | 204/43 |
| 3,090,733 | 5/1963 | Brown | 204/40 |
| 3,576,724 | 4/1971 | Reddy et al. | 204/47 |
| 3,772,168 | 11/1973 | Dillenberg | 204/435 |
| 3,778,238 | 12/1973 | Tyler et al. | 29/196.3 |
| 3,793,162 | 2/1974 | Hope | 204/47 |
| 3,887,444 | 6/1975 | Fueki et al. | 204/435 |
| 3,940,319 | 2/1976 | Pollack | 204/435 |
| 4,029,556 | 6/1977 | Monaco et al. | 204/40 |
| 4,033,835 | 7/1977 | Lerner et al. | 204/435 |
| 4,049,508 | 9/1977 | Morrissey | 204/435 |
| 4,082,622 | 4/1978 | Gebauer | 204/40 |
| 4,252,862 | 2/1981 | Nishida | 428/457 |
| 4,297,178 | 10/1981 | Crosby | 204/47 |
| 4,377,448 | 3/1983 | Kohl | 204/46 G |
| 4,418,125 | 11/1983 | Henricks | 428/639 |
| 4,421,611 | 12/1983 | Cameron | 204/43 T |
| 4,507,183 | 3/1985 | Thomas et al. | 204/98 |
| 4,556,607 | 12/1985 | Sastri | 428/627 |
| 4,591,418 | 5/1986 | Snyder | 204/192 P |
| 4,640,869 | 2/1987 | Loth | 428/469 |
| 4,699,850 | 10/1987 | Kishi et al. | 428/469 |
| 4,761,346 | 8/1988 | Naik | 428/627 |
| 4,847,445 | 7/1989 | Helderman et al. | 174/68.5 |
| 4,849,303 | 7/1989 | Graham et al. | 428/670 |
| 4,911,798 | 3/1990 | Abys et al. | 204/44 |
| 5,024,733 | 6/1991 | Abys et al. | 204/3 |
| 5,102,509 | 4/1992 | Albon et al. | 205/257 |
| 5,178,745 | 1/1993 | Abys et al. | 205/219 |

(List continued on next page.)

FOREIGN PATENT DOCUMENTS

| | | |
|---|---|---|
| 56-166063 | 12/1981 | Japan . |
| 59-9189 | 1/1984 | Japan . |

OTHER PUBLICATIONS

Frederick Lowerheim, Modern Electroplating, 1963, pp. 279–280.

Atotech, Technical Information (Bulletin) Oct. 30, 1994.

Electroplating, Frederick A. Lowenheim—1978, pp. 210–225 no month.

*Primary Examiner*—John J. Zimmerman
*Assistant Examiner*—Michael LaVilla
*Attorney, Agent, or Firm*—Myron B. Kapustiji; Malcolm L. Sutherland

[57] ABSTRACT

An article is coated with a multilayer coating comprising a semi-bright nickel layer deposited on the surface of the article, a bright nickel layer deposited on the bright nickel layer, a gold layer deposited on the semi-bright nickel layer, a ruthenium layer deposited on the gold layer, a refractory metal, preferably zirconium, strike layer deposited on the ruthenium layer, and a refractory metal compound, preferably zirconium nitride, deposited on the refractory metal strike layer. The coating provides the color of polished brass to the article and also provides abrasion and corrosion protection.

15 Claims, 1 Drawing Sheet

U.S. PATENT DOCUMENTS 5,250,105 10/1993 Gomes et al. ..... 106/1.11
5,314,608 5/1994 Caballero ..... 205/238
5,413,874 5/1995 Moysan, III et al. ..... 428/627
5,476,724 12/1995 Moysan, III et al. ..... 428/627
5,478,659 12/1995 Moysan, III et al. ..... 428/627
5,478,660 12/1995 Moysan, III et al. ..... 428/627
5,482,788 1/1996 Moysan, III et al. ..... 428/627
5,484,663 1/1996 Moysan, III et al. ..... 428/627

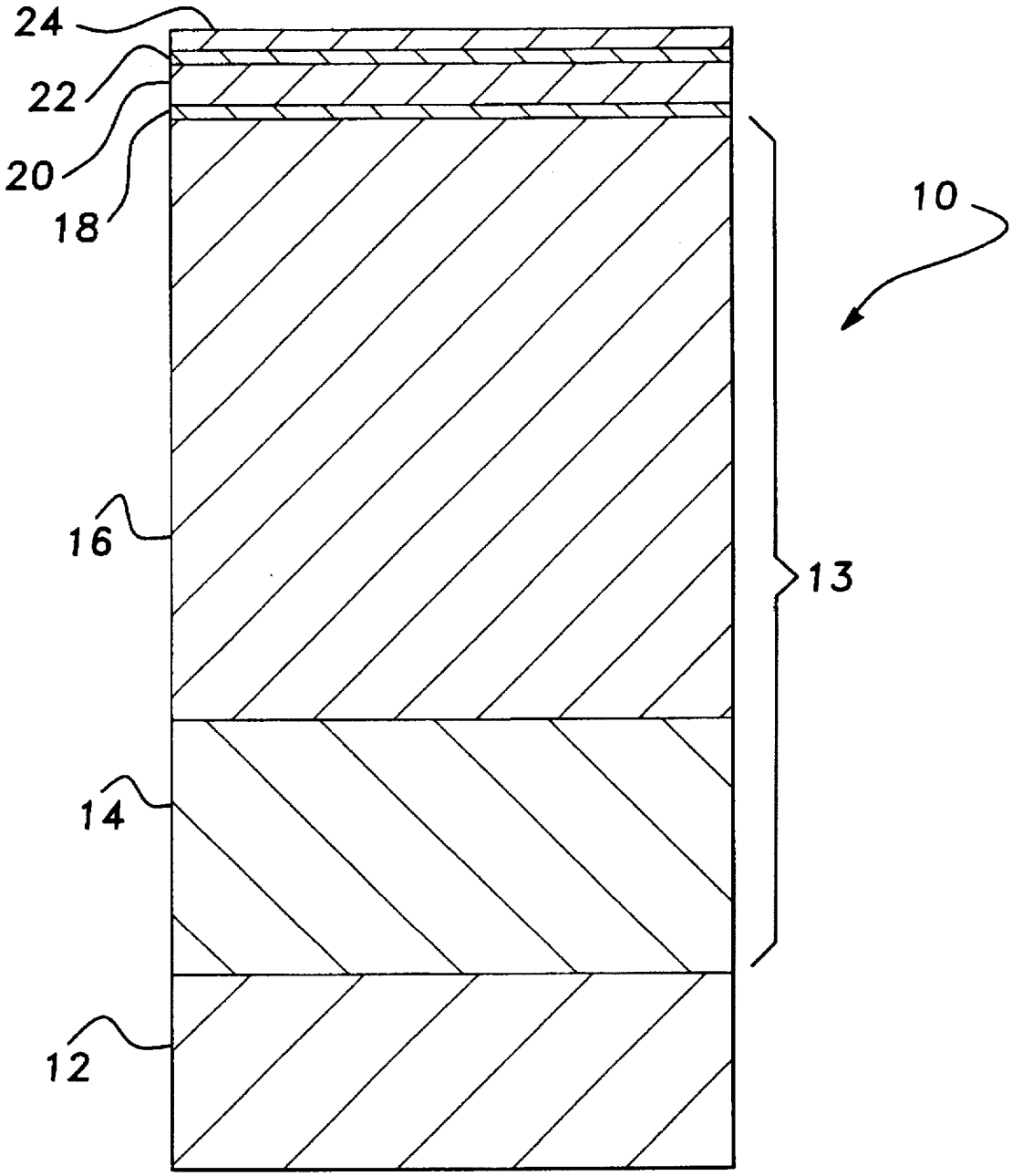
24
22
20
18
10
16
13
14
12

ARTICLE WITH PROTECTIVE COATING THEREON

FIELD OF THE INVENTION

The instant invention is directed to protective multilayer metallic coatings for metallic substrates.

BACKGROUND OF THE INVENTION

It is currently the practice with various brass articles such as lamps, trivets, candlesticks, door knobs and handles and the like to first buff and polish the surface of the article to a high gloss and to then apply a protective organic coating, such as one comprised of acrylics, urethanes, epoxies, and the like, onto this polished surface. While this system is generally quite satisfactory it has the drawback that the buffing and polishing operation, particularly if the article is of a complex shape, is labor intensive. Also, the known organic coatings are not always as durable as desired, particularly in outdoor applications where the articles they are exposed to the elements and ultraviolet radiation. It would, therefore, be quite advantageous if brass articles, or indeed other metallic articles, could be provided with a coating which gave the article the appearance of highly polished brass and also provided wear resistance and corrosion protection. The present invention provides such a coating.

SUMMARY OF THE INVENTION

The present invention is directed to a metallic substrate having a multi-layer coating disposed or deposited on its surface. More particularly, it is directed to a metallic substrate, particularly brass, having deposited on its surface multiple superposed metallic layers of certain specific types of metals or metal compounds or metal alloys. The coating is decorative and protective, e.g., provides corrosion and wear resistance. The coating simulates the appearance of highly polished brass, i.e. has a brass color tone. Thus, an article surface having the coating thereon simulates a highly polished brass surface.

A first layer deposited directly on the surface of the substrate is comprised of nickel. The first layer preferably consists of two different nickel layers such as a semi-bright nickel layer deposited directly on the surface of the substrate and a bright nickel layer superimposed over the semi-bright nickel layer. Disposed over the nickel layer is a layer comprised of gold. This gold layer is thinner than the nickel layer. Over the gold layer is a layer comprised of ruthenium. Over the ruthenium layer is a layer comprised of a non-precious refractory metal such as zirconium, titanium, hafnium or tantalum, preferably zirconium or titanium. A top layer comprised of a zirconium compound, titanium compound, hafnium compound or tantalum compound, preferably a titanium compound or a zirconium compound such as zirconium nitride, is disposed over the refractory metal layer, preferably zirconium layer.

The nickel, gold and ruthenium layers are preferably applied by electroplating. The refractory metal layer such as zirconium layer and refractory metal compound layer such as zirconium compound layer are applied by vapor deposition such as sputter ion deposition.

BRIEF DESCRIPTION OF THE DRAWINGS

FIG. 1 is a cross-sectional view of a portion of the substrate having the multi-layer coating deposited on its surface.

DESCRIPTION OF THE PREFERRED EMBODIMENT

The substrate 12 can be any metal or metallic alloy substrate such as copper, steel, brass, tungsten, nickel alloys, and the like. In a preferred embodiment the substrate is brass.

The nickel layer 13 is deposited on the surface of the substrate 12 by conventional and well known electroplating processes. These processes include using a conventional electroplating bath such as, for example, a Watts bath as the plating solution. Typically such baths contain nickel sulfate, nickel chloride, and boric acid dissolved in water. Chloride, sulfamate and fluoroborate plating solutions can also be used. These baths can optionally include a number of well known and conventionally used compounds such as leveling agents, brighteners, and the like. To produce specularly bright nickel layer at least one brightener from class I and at least one brightener from class II is added to the plating solution. Class I brighteners are organic compounds which contain sulfur. Class II brighteners are organic compounds which do not contain sulfur. Class II brighteners can also cause leveling and, when added to the plating bath without the sulfur-containing class I brighteners, result in semi-bright nickel deposits. These class I brighteners include alkyl naphthalene and benzene sulfonic acids, the benzene and naphthalene di- and trisulfonic acids, benzene and naphthalene sulfonamides, and sulfonamides such as saccharin, vinyl and allyl sulfonamides and sulfonic acids. The class II brighteners generally are unsaturated organic materials such as, for example, acetylenic or ethylenic alcohols, ethoxylated and propoxylated acetylenic alcohols, coumarins, and aldehydes. These Class I and Class II brighteners are well known to those skilled in the art and are readily commercially available. They are described, inter alia, in U.S. Pat. No. 4,421,611 incorporated herein by reference.

The nickel layer is preferably comprised of a duplex layer containing a layer comprised of semi-bright nickel and a layer comprised of bright nickel. The thickness of the nickel layer is generally in the range of from about 100 millionths (0.000100) of an inch, preferably about 150 millionths (0.000150) of an inch to about 3,500 millionths (0.0035) of an inch.

As is well known in the art before the nickel layer is deposited on the substrate the substrate is subjected to said activation by being placed in a conventional and well known acid bath.

In a preferred embodiment as illustrated in the Figure, the nickel layer 13 is comprised of two different nickel layers 14 and 16. Layer 14 is comprised of semi-bright nickel while layer 16 is comprised of bright nickel. This duplex nickel deposit provides improved corrosion protection to the underlying substrate. The semi-bright, sulfur-free plate 14 is deposited, by conventional electroplating processes, directly on the surface of substrate 12. The substrate 12 containing the semi-bright nickel layer 14 is then placed in a bright nickel plating bath and the bright nickel layer 16 is deposited on the semi-bright nickel layer 14.

The thickness of the semi-bright nickel layer and the bright nickel layer is a thickness effective to provide improved corrosion protection. Generally, the thickness of the semi-bright nickel layer is at least about 50 millionths (0.00005) of an inch, preferably at least about 100 millionths (0.000100) of an inch, and more preferably at least about 150 millionths (0.00015) of an inch. The upper thickness limit is generally not critical and is governed by secondary considerations such as cost. Generally, however, a thickness of about 1,500 millionths (0.0015) of an inch, preferably about 1,000 millionths (0.001) of an inch, and more preferably about 750 millionths (0.00075) of an inch should not be exceeded. The bright nickel layer 16 generally has a thickness of at least about 50 millionths (0.00005) of an inch, preferably at least about 125 millionths (0.000125) of an inch, and more preferably at least about 250 millionths (0.000250) of an inch. The upper thickness range of the bright nickel layer is not critical and is generally controlled by considerations such as cost. Generally, however, a thickness of about 2,500 millionths (0.0025) of an inch, preferably about 2,000 millionths (0.002) of an inch, and more preferably about 1,500 millionths (0.0015) of an inch should not be exceeded. The bright nickel layer 16 also functions as a leveling layer which tends to cover or fill in imperfections in the substrate.

Disposed on the bright nickel layer 16 is a relatively thin layer comprised of gold. The gold layer 18 may be deposited on layer 16 by conventional and well known gold deposition techniques. These techniques include but are not limited to plating, preferably electroplating techniques. The gold electroplating processes and baths are conventional and well known in the art. Some gold plating processes and baths are described in Gold Plating Techniques, F. H. Reed et al, Electro-Chemical Publications Limited, Scotland, 1974, and in U.S. Pat. Nos. 4,377,448 and 4,082,622, all of which are incorporated herein by reference.

Various types of gold electroplating solutions may be used including phosphate buffered solutions and citrate buffered solutions. Two typical solutions are given below.

| | |
|---|---|
| $KAu(CN)_2$ | 20 g/l |
| $K_2HPO_4 3H_2O$ | 40 g/l |
| $KH_2PO_4$ | 10 g/l |

Optimum plating temperature is 65+ degrees C.

| | |
|---|---|
| $KAu(CN)_2$ | 20 g/l |
| $(NH)_4)_2HC_6H_5O_7$ | 50 g/l. |

Conductivity may be increased by adding (typically 50 g/l) $(NH_4)_2SO_4$. Optimum plating temperature is 65+ degrees C.

The gold layer generally has a thickness of at least about 0.25 millionths (0.00000025) of an inch, preferably at least about 0.5 millionths (0.0000005) of an inch, and more preferably at least about one millionth (0.000001) of an inch. Generally, the upper range of thickness is not critical and is determined by secondary considerations such as cost. However, the thickness of the gold layer should generally not exceed about 50 millionths (0.00005) of an inch, preferably 15 millionths (0.000015) of an inch, and more preferably 10 millionths (0.000010) of an inch.

The ruthenium layer 20 is deposited on the gold layer 18 in a variety of conventional and well known ways such as for example by plating, sputtering, vacuum deposition, and depositing the ruthenium metal as a finely divided dispersion in an organic vehicle. The ruthenium is preferably deposited by plating, preferably electroplating. The ruthenium electroplating processes and plating baths are conventional and well known. They are described, for example, in The Journal of the Chemical Society of London, 1971 edition, page 839, by C. D. Burke and J. O. O'Meardi and Electrodeposition of Alloys, Vol. II, pp. 4–29, Abner Brenner (1963). The ruthenium electroplating baths may be acidic or nonacidic. Some illustrative examples of nonacidic ruthenium electroplating baths are described in U.S. Pat. Nos. 4,297,178 and 4,507,183, both of which are incorporated herein by reference. Some illustrative examples of acid ruthenium plating baths are described in U.S. Pat. No. 3,793,162, incorporated herein by reference. Some other ruthenium plating baths are disclosed in U.S. Pat. Nos. 3,576,724 and 4,377,448, both of which are incorporated herein by reference. The ruthenium plating baths include the nitrous salt baths and the sulfamate baths.

The ruthenium may be electroplated by use of continuous direct current densities or by use of pulse current plating, i.e., where a current is generated for a first time period and is absent during a second time period, the first and second time period reoccur cyclically. Pulse current plating of ruthenium is described, for example, in U.S. Pat. No. 4,082,622, incorporated herein by reference.

The thickness of the ruthenium layer 20 is at least about 2 millionths (0.000002) of an inch, preferably at least about 5 millionths (0.000005) of an inch, and more preferably at least about 8 millionths (0.000008) of an inch. The upper thickness range is not critical and is generally dependent on economic considerations. Generally, a thickness of about 100 millionths (0.0001) of an inch, preferably about 50 millionths (0.00005), and more preferably about 25 millionths (0.000025) of an inch should not be exceeded.

Disposed over the ruthenium layer 20 is a layer 22 comprised of a non-precious refractory metal such as hafnium, tantalum, zirconium or titanium, preferably zirconium or titanium, and more preferably zirconium.

Layer 22 serves, inter alia, to improve or enhance the adhesion of layer 24 to layer 20. Layer 22 is deposited on the ruthenium layer 20 by conventional and well known techniques such as vacuum coating, physical vapor deposition such as ion sputtering, and the like. Ion sputtering techniques and equipment are disclosed, inter alia, in T. Van Vorous, "Planar Magnetron Sputtering; A New Industrial Coating Technique", Solid State Technology, December 1976, pp 62–66; U. Kapacz and S. Schulz, "Industrial Application of Decorative Coatings—Principle and Advantages of the Sputter Ion Plating Process", Soc. Vac. Coat., Proc. 34th Arn. Techn. Conf., Philadelphia, U.S.A., 1991, 48–61; and U.S. Pat. Nos. 4,162,954, and 4,591,418, all of which are incorporated herein by reference.

Briefly, in the sputter ion deposition process the refractory metal such as titanium or zirconium target, which is the cathode, and the substrate are placed in a vacuum chamber. The air in the chamber is evacuated to produce vacuum conditions in the chamber. An inert gas, such as Argon, is introduced into the chamber. The gas particles are ionized and are accelerated to the target to dislodge titanium or zirconium atoms. The dislodged target material is then typically deposited as a coating film on the substrate.

Layer 22 has a thickness which is at least effective to improve the adhesion of layer 24 to ruthenium layer 20. Generally, this thickness is at least about 0.25 millionths (0.00000025) of an inch, preferably at least about 0.5 millionths (0.0000005) of an inch, and more preferably at least about one millionth (0.000001) of an inch. The upper thickness range is not critical and is generally dependent upon considerations such as cost. Generally, however, layer 22 should not be thicker than about 50 millionths (0.00005) of an inch, preferably about 15 millionths (0.000015) of an inch, and more preferably about 10 millionths (0.000010) of an inch.

In a preferred embodiment of the present invention layer 22 is comprised of titanium or zirconium, preferably zirconium, and is deposited by sputter ion plating.

Layer 24 is comprised of a hafnium compound, a tantalum compound, a titanium compound or a zirconium compound, preferably a titanium compound or a zirconium compound, and more preferably a zirconium compound. The titanium compound is selected from titanium nitride, titanium carbide, and titanium carbonitride, with titanium nitride being preferred. The zirconium compound is selected from zirconium nitride, zirconium carbonitride, and zirconium carbide, with zirconium nitride being preferred.

Layer 24 provides wear and abrasion resistance and the desired color or appearance, such as for example, polished brass. Layer 24 is deposited on layer 22 by any of the well known and conventional plating or deposition processes such as vacuum coating, reactive sputter ion plating, and the like. The preferred method is reactive ion sputter plating.

Reactive ion sputter is generally similar to ion sputter deposition except that a reactive gas which reacts with the dislodged target material is introduced into the chamber. Thus, in the case where zirconium nitride is the top layer 24, the target is comprised of zirconium and nitrogen gas is the reactive gas introduced into the chamber. By controlling the amount of nitrogen available to react with the zirconium, the color of the zirconium nitride can be made to be similar to that of brass of various hues.

Layer 24 has a thickness at least effective to provide abrasion resistance. Generally, this thickness is at least 2 millionths (0.000002) of an inch, preferably at least 4 millionths (0.000004) of an inch, and more preferably at least 6 millionths (0.000006) of an inch. The upper thickness range is generally not critical and is dependent upon considerations such as cost. Generally a thickness of about 30 millionths (0.00003) of an inch, preferably about 25 millionths (0.000025) of an inch, and more preferably about 20 millionths (0.000020) of an inch should not be exceeded.

Zirconium nitride is the preferred coating material as it most closely provides the appearance of polished brass.

In order that the invention may be more readily understood the following example is provided. The example is illustrative and does not limit the invention thereto.

EXAMPLE 1

Brass door escutcheons are placed in a conventional Soak cleaner bath containing the standard and well known soaps, detergents, defloculants and the like which is maintained at a pH of 8.9–9.2 and a temperature of 180°–200° F. for 30 minutes. The brass escutcheons are then placed for six minutes in a conventional ultrasonic alkaline cleaner bath. The ultrasonic cleaner bath has a pH of 8.9–9.2, is maintained at a temperature of about 160°–180° F., and contains the conventional and well known soaps, detergents, defloculants and the like. After the ultrasonic cleaning the escutcheons are rinsed and placed in a conventional alkaline electro cleaner bath for about two minutes. The electro cleaner bath contains an insoluble submerged steel anode, is maintained at a temperature of about 140°–180° F., a pH of about 10.5–11.5, and contains standard and conventional detergents. The escutcheons are then rinsed twice and placed in a conventional acid activator bath for about one minute. The acid activator bath has a pH of about 2.0–3.0, is at an ambient temperature, and contains a sodium fluoride based acid salt. The escutcheons are then rinsed twice and placed in a semi-bright nickel plating bath for about 10 minutes. The semi-bright nickel bath is a conventional and well known bath which has a pH of about 4.2–4.6, is maintained at a temperature of about 130°–150° F., contains $NiSO_4$, $NiCL_2$, boric acid, and brighteners. A semi-bright nickel layer of an average thickness of about 250 millionths of an inch (0.00025) is deposited on the surface of the escutcheon.

The escutcheons containing the layer of semi-bright nickel are then rinsed twice and placed in a bright nickel plating bath for about 24 minutes. The bright nickel bath is generally a conventional bath which is maintained at a temperature of about 130°–150° F., a pH of about 4.0–4.8, contains $NiSO_4$, $NiCL_2$, boric acid, and brighteners. A bright nickel layer of an average thickness of about 750 millionths (0.00075) of an inch is deposited on the semi-bright nickel layer. The semi-bright and bright nickel plated escutcheons are rinsed three times and placed in a conventional gold plating bath for about 30 seconds. The gold bath utilizes insoluble platinized titanium anodes, is maintained at a temperature of about 100 deg–150 deg F., a pH of about 4.0–4.5, and contains about 4 grams per liter of gold. A gold layer of an average thickness of about 3 millionths of an inch is deposited over the bright nickel layer. The escutcheons are then rinsed twice.

The gold plated escutcheons are then placed into a conventional ruthenium plating bath for about ten minutes. The ruthenium bath utilizes insoluble platinized titanium anodes, is maintained at a temperature of about 150 deg–170 deg F., a pH of about 1.0–2.0, and contains about 3 grams per liter of ruthenium. A ruthenium layer of an average thickness of about 10 millionths of an inch is deposited over the palladium layer. The escutcheons are then thoroughly rinsed and dried.

The ruthenium plated escutcheons are placed in a sputter ion plating vessel. This vessel is a stainless steel vacuum vessel marketed by Leybold A. G. of Germany. The vessel is generally a cylindrical enclosure containing a vacuum chamber which is adapted to be evacuated by means of pumps. A source of argon gas is connected to the chamber by an adjustable valve for varying the rate of flow of argon into the chamber. In addition, two sources of nitrogen gas are connected to the chamber by an adjustable valve for varying the rate of flow of nitrogen into the chamber.

Two pairs of magnetron-type target assemblies are mounted in a spaced apart relationship in the chamber and connected to negative outputs of variable D.C. power supplies. The targets constitute cathodes and the chamber wall is an anode common to the target cathodes. The target material comprises zirconium.

A substrate carrier which carries the substrates, i.e., escutcheons, is provided, e.g., it may be suspended from the top of the chamber, and is rotated by a variable speed motor to carry the substrates between each pair of magnetron target assemblies. The carrier is conductive and is electrically connected to the negative output of a variable D.C. power supply.

The ruthenium plated escutcheons are mounted onto the substrate carrier in the sputter ion plating vessel. The vacuum chamber is evacuated to a pressure of about $5\times10^{-3}$ millibar and is heated to about 400° C. via a radiative electric resistance heater. The target material is sputter cleaned to remove contaminants from its surface. Sputter cleaning is carried out for about one half minute by applying power to the cathodes sufficient to achieve a current flow of about 18 amps and introducing argon gas at the rate of about 200 standard cubic centimeters per minute. A pressure of about $3\times10^{-3}$ millibars is maintained during sputter cleaning.

The escutcheons are then cleaned by a low pressure etch process. The low pressure etch process is carried on for about five minutes and involves applying a negative D.C. potential which increases over a one minute period from about 1200 to about 1400 volts to the escutcheons and applying D.C. power to the cathodes to achieve a current flow of about 3.6 amps. Argon gas is introduced at a rate which increases over a one minute period from about 800 to about 1000 standard cubic centimeters per minute, and the pressure is maintained at about $1.1\times10^{-2}$ millibars. The escutcheons are rotated between the magnetron target assemblies at a rate of one revolution per minute. The escutcheons are then subjected to a high pressure etch cleaning process for about 15 minutes. In the high pressure etch process argon gas is introduced into the vacuum chamber at a rate which increases over a 10 minute period from about 500 to 650 standard cubic centimeters per minute (i.e., at the beginning the flow rate is 500 sccm and after ten minutes the flow rate is 650 sccm and remains 650 sccm during the remainder of the high pressure etch process), the pressure is maintained at about $2\times10^{-1}$ millibars, and a negative potential which increases over a ten minute period from about 1400 to 2000 volts is applied to the escutcheons. The escutcheons are rotated between the magnetron target assemblies at about one revolution per minute. The pressure in the vessel is maintained at about $2\times10^{-1}$ millibar.

The escutcheons are then subjected to another low pressure etch cleaning process for about five minutes. During this low pressure etch cleaning process a negative potential of about 1400 volts is applied to the escutcheons, D.C. power is applied to the cathodes to achieve a current flow of about 2.6 amps, and argon gas is introduced into the vacuum chamber at a rate which increases over a five minute period from about 800 sccm (standard cubic centimeters per minute) to about 1000 sccm. The pressure is maintained at about $1.1\times10^{-2}$ millibar and the escutcheons are rotated at about one rpm.

The target material is again sputter cleaned for about one minute by applying power to the cathodes sufficient to achieve a current flow of about 18 amps, introducing argon gas at a rate of about 150 sccm, and maintaining a pressure of about $3\times10^{-3}$ millibars.

During the cleaning process shields are interposed between the escutcheons and the magnetron target assemblies to prevent deposition of the target material onto the escutcheons.

The shields are removed and a layer of zirconium having an average thickness of about 3 millionths (0.000003) of an inch is deposited on the ruthenium layer of the escutcheons during a four minute period. This sputter deposition process comprises applying D.C. power to the cathodes to achieve a current flow of about 18 amps, introducing argon gas into the vessel at about 450 sccm, maintaining the pressure in the vessel at about $6\times10^{-3}$ millibar, and rotating the escutcheons at about 0.7 revolutions per minute.

After the zirconium layer is deposited a zirconium nitride layer having an average thickness of about 14 millionths (0.000014) of an inch is deposited on the zirconium layer by reactive ion sputtering over a 14 minute period. A negative potential of about 200 volts D.C. is applied to the escutcheons while D.C. power is applied to the cathodes to achieve a current flow of about 18 amps. Argon gas is introduced at a flow rate of about 500 sccm. Nitrogen gas is introduced into the vessel from two sources. One source introduces nitrogen at a generally steady flow rate of about 40 sccm. The other source is variable. The variable source is regulated so as to maintain a partial ion current of $6.3\times10^{-11}$ amps, with the variable flow of nitrogen being increased or decreased as necessary to maintain the partial ion current at this predetermined value.

The pressure in the vessel is maintained at about $7.5\times10^{-3}$ millibar.

The zirconium-nitride coated escutcheons are then subjected to low pressure cool down, where the heating is discontinued, pressure is increased from about $1.1\times10^{-2}$ millibar to about $2\times10^{-1}$ millibar, and argon gas is introduced at a rate of 950 sccm.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. An article comprising a metallic substrate having disposed on at least a portion of its surface a multi-layer coating comprising:

a first layer comprised of semi-bright nickel on at least a portion of said surface of said substrate;

a second layer comprised of bright nickel on at least a portion of said layer comprised of semi-bright nickel;

a third layer comprised of gold on at least a portion of said layer comprised of bright nickel;

a fourth layer comprised of ruthenium on at least a portion of said layer comprised of gold;

a fifth layer comprised of zirconium on at least a portion of said layer comprised of ruthenium; and a top layer having a thickness effective to at least provide the color of brass comprised of zirconium compound on at least a portion of said layer comprised of zirconium.

2. The article of claim 1 wherein said zirconium compound is comprised of zirconium nitride.

3. The article of claim 1 wherein said metallic substrate is comprised of brass.

4. An article comprising a substrate having on at least a portion of its surface a coating comprising a bottom layer comprised of semi-bright nickel;

a layer comprised of bright nickel;

a layer comprised of gold;

a layer comprised of ruthenium;

a layer comprised of zirconium; and a top layer having a thickness effective to at least provide the color of brass comprised of a zirconium compound.

5. The article of claim 4 wherein said substrate is comprised of brass.

6. The article of claim 5 wherein said layer comprised of zirconium compound is comprised of zirconium nitride.

7. The article of claim 4 wherein said layer comprised of zirconium compound is comprised of zirconium nitride.

8. An article comprising a metallic substrate having disposed on at least a portion of its surface a multi-layer coating comprising:

a first layer comprised of semi-bright nickel;

a second layer comprised of bright nickel;

a third layer comprised of gold;

a fourth layer comprised of ruthenium;

a fifth layer comprised of zirconium; and a top layer having a thickness effective to at least provide the color of brass comprised of zirconium compound.

9. The article of claim 8 wherein said zirconium compound is comprised of zirconium nitride.

10. The article of claim 9 wherein said metallic substrate is comprised of brass.

11. The article of claim 8 wherein said metallic substrate is comprised of brass.

12. An article comprising a substrate having on at least a portion of its surface a coating comprising a first layer comprised of semi-bright nickel;

a second layer on at least a portion of said first layer comprised of bright nickel;

a third layer on at least a portion of said second layer comprised of gold;

a fourth layer on at least a portion of said third layer comprised of ruthenium;

a fifth layer on at least a portion of said fourth layer comprised of zirconium; and a top layer having a thickness at least effective to provide the color of brass on at least a portion of said fifth layer comprised of a zirconium compound.

13. The article of claim 12 wherein said substrate is comprised of brass.

14. The article of claim 12 wherein said top layer is comprised of zirconium nitride.

15. The article of claim 14 wherein said substrate is comprised of brass.

* * * * *